US010544716B2

(12) United States Patent
Son et al.

(10) Patent No.: US 10,544,716 B2
(45) **Date of Patent: *Jan. 28, 2020**

(54) VALVE DURATION CONTROL APPARATUS AND ENGINE PROVIDED WITH THE SAME

(71) Applicant: Hyundai Motor Company, Seoul (KR)

(72) Inventors: You Sang Son, Suwon-si (KR); Kyoung Pyo Ha, Seongnam-si (KR); Back Sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 1111 days.

This patent is subject to a terminal disclaimer.

(21) Appl. No.: 14/940,553

(22) Filed: Nov. 13, 2015

(65) Prior Publication Data

US 2016/0160703 A1 Jun. 9, 2016

(30) Foreign Application Priority Data

Dec. 9, 2014 (KR) ..... 10-2014-0175835

(51) Int. Cl.
*F01L 13/00* (2006.01)

(52) U.S. Cl.
CPC ... *F01L 13/0015* (2013.01); *F01L 2013/0084* (2013.01)

(58) Field of Classification Search
CPC ..... F01L 13/0015; F01L 2013/0084; F01L 2001/0473; F01L 1/34413; F01L 1/46; F01L 2013/0089; F02D 13/0215; F02D 13/0234; F02D 13/0249
USPC ..... 123/90.15, 90.16, 90.17, 90.27
See application file for complete search history.

(56) References Cited

U.S. PATENT DOCUMENTS

| | | | |
|---|---|---|---|
| 5,924,334 | A | 7/1999 | Hara et al. |
| 7,721,691 | B2 | 5/2010 | Tateno |
| 2009/0000582 | A1 | 1/2009 | Tanabe et al. |
| 2010/0059005 | A1 | 3/2010 | Stone et al. |
| 2013/0146006 | A1 | 6/2013 | Kim et al. |

FOREIGN PATENT DOCUMENTS

| | | | |
|---|---|---|---|
| CN | 101182807 | A | 5/2008 |
| CN | 102477879 | A | 5/2012 |
| CN | 103061844 | A | 4/2013 |
| DE | 198 25 307 | A1 | 12/1999 |
| JP | H10-280927 | A | 10/1998 |
| JP | 2009-236010 | A | 10/2009 |
| JP | 2012-229632 | A | 11/2012 |
| KR | 10-2013-0063819 | A | 6/2013 |
| KR | 10-1326818 | B1 | 11/2013 |

*Primary Examiner* — Patrick Hamo
*Assistant Examiner* — Paul W Thiede
(74) *Attorney, Agent, or Firm* — Morgan, Lewis & Bockius LLP

(57) ABSTRACT

A continuous variable valve duration apparatus may include a camshaft, a plurality of wheels mounted to the camshaft, of which a wheel key is formed thereto respectively, a plurality of cam portions of which a cam and a cam key are formed thereto respectively, of which the camshaft is inserted thereto, of which relative phase angle with respect to the camshaft is variable, a plurality of inner brackets connected with the each wheel key and the each cam key, a plurality of a slider housings of which the each inner bracket is rotatably inserted thereto respectively, and rotatably configured around a hinge hole formed a side of a cam cap and a control portion selectively moving the slider housings to change relative position of a rotation center of the inner brackets.

15 Claims, 8 Drawing Sheets

VALVE DURATION CONTROL APPARATUS AND ENGINE PROVIDED WITH THE SAME

CROSS-REFERENCE TO RELATED APPLICATION

The present application claims priority to and the benefit of Korean Patent Application No. 10-2014-0175835 filed on Dec. 9, 2014, the entire contents of which is incorporated herein for all purposes by this reference.

BACKGROUND OF THE INVENTION

Field of the Invention

The present invention relates to a continuous variable valve duration apparatus and an engine provided with the same. More particularly, the present invention relates to a continuous variable valve duration apparatus an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directly providing a continuous variable valve duration apparatus and an engine provided with the same which may vary opening duration of a valve according to operation conditions of an engine, with a simple construction.

According to various aspects of the present invention, a continuous variable valve duration apparatus may include a camshaft, a plurality of wheels mounted to the camshaft, of which a wheel key is formed thereto respectively, a plurality of cam portions of which a cam and a cam key are formed thereto respectively, of which the camshaft is inserted thereto, of which relative phase angle with respect to the camshaft is variable, a plurality of inner brackets connected with the each wheel key and the each cam key, a plurality of a slider housings of which the each inner bracket is rotatably inserted thereto respectively, and rotatably configured around a hinge hole formed a side of a cam cap and a control portion selectively moving the slider housings so as to change relative position of a rotation center of the inner brackets.

The continuous variable valve duration apparatus may further include first pins of which a wheel key slot, the each wheel key is slidably inserted thereto, is formed thereto respectively and second pins of which a cam key slot, the each cam key is slidably inserted thereto, is formed thereto respectively, and a first sliding pin hole and a second sliding pin hole, of which the first pin and the second pin are inserted thereto respectively, may be formed to the inner bracket.

The first pin and the second pin may be formed as a circular cylinder shape and the first sliding pin hole and the second sliding pin hole may be formed for the first pin and the second pin to be rotated within thereto.

The wheel key slot of the first pin and the cam key slot of the second pin may be formed opposite direction.

Parts of the first sliding pin hole and the second sliding pin hole may be opened for movements of the wheel key and the cam key not to be interrupted.

The continuous variable valve duration apparatus may further include a bearing inserted between the slider housing and the inner bracket.

The slider housings may be connected each other through a slider housing connecting rod and a connecting bracket and a hinge pin, inserted into the hinge hole, may be connected the connecting bracket.

The control portion may include a control gear connected to the slider housing and a control motor engaged with the control gear and selectively rotating the control gear.

The wheel may be connected with the camshaft through a connecting pin.

According to various aspects of the present invention, an engine may include a camshaft, a plurality of wheels mounted to the camshaft, of which a wheel key is formed thereto respectively, and disposed corresponding to each cylinder, a plurality of cam portions of which a cam and a cam key are formed thereto respectively, of which the camshaft is inserted thereto, of which relative phase angle with respect to the camshaft is variable and disposed corresponding to the each cylinder, a plurality of inner brackets of which a first sliding pin hole and a second sliding pin hole, connected with the each wheel key and the each cam key; are formed respectively thereto, a plurality of a slider housings of which the each inner bracket is rotatably inserted thereto, and rotatably configured around a hinge hole formed to a side of a cam cap, first pins of which a wheel key slot, the each wheel key is slidably inserted thereto, is formed thereto respectively and rotatably inserted into the first sliding pin hole, second pins of which a cam key slot, the each the cam key is slidably inserted thereto, is formed thereto opposite to the wheel key slot respectively, and rotatably inserted into the second sliding pin hole and a control portion selectively moving the slider housings so as to change relative position of a rotation center of the inner brackets.

Parts of the first sliding pin hole and the second sliding pin hole may be opened for movements of the wheel key and the cam key not to be interrupted.

The engine may further include a bearing inserted between the slider housing and the inner bracket.

The slider housings may be connected each other through a slider housing connecting rod and a connecting bracket and a hinge pin, inserted into the hinge hole, may be connected the connecting bracket.

The control portion may include a control gear connected to the slider housing and a control motor engaged with the control gear and selectively rotating the control gear.

The wheel may be connected with the camshaft through a connecting pin.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
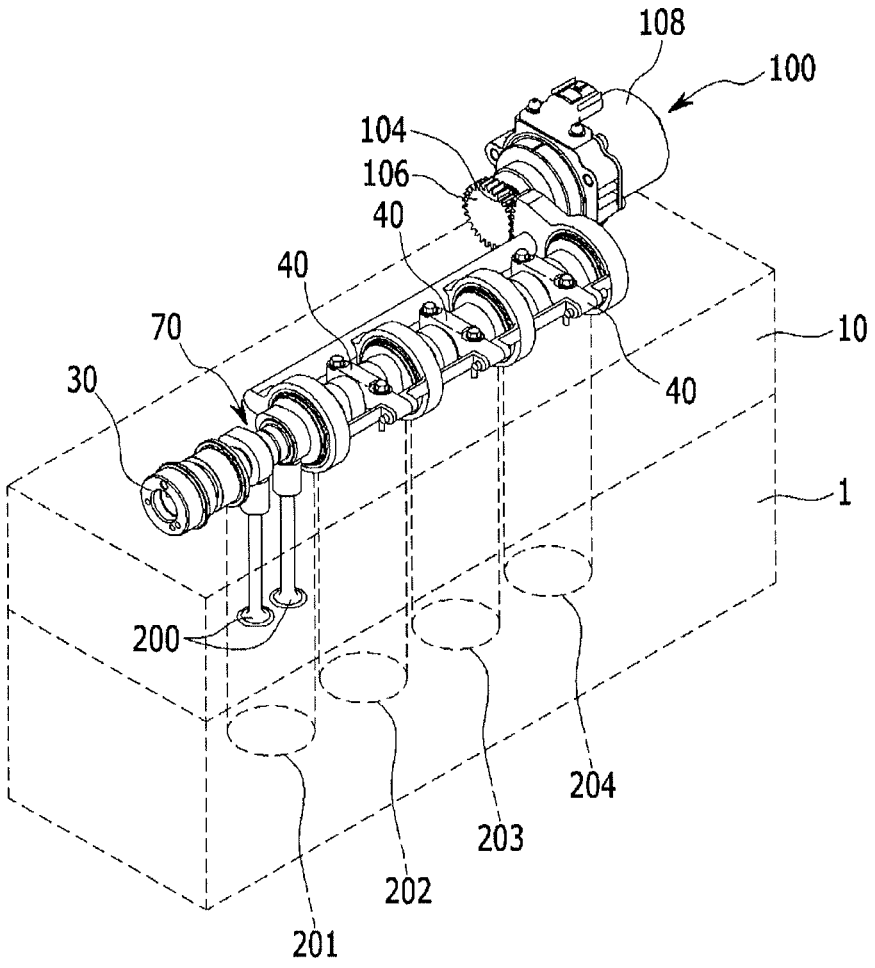
FIG. 1 is a perspective view of an engine provided with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
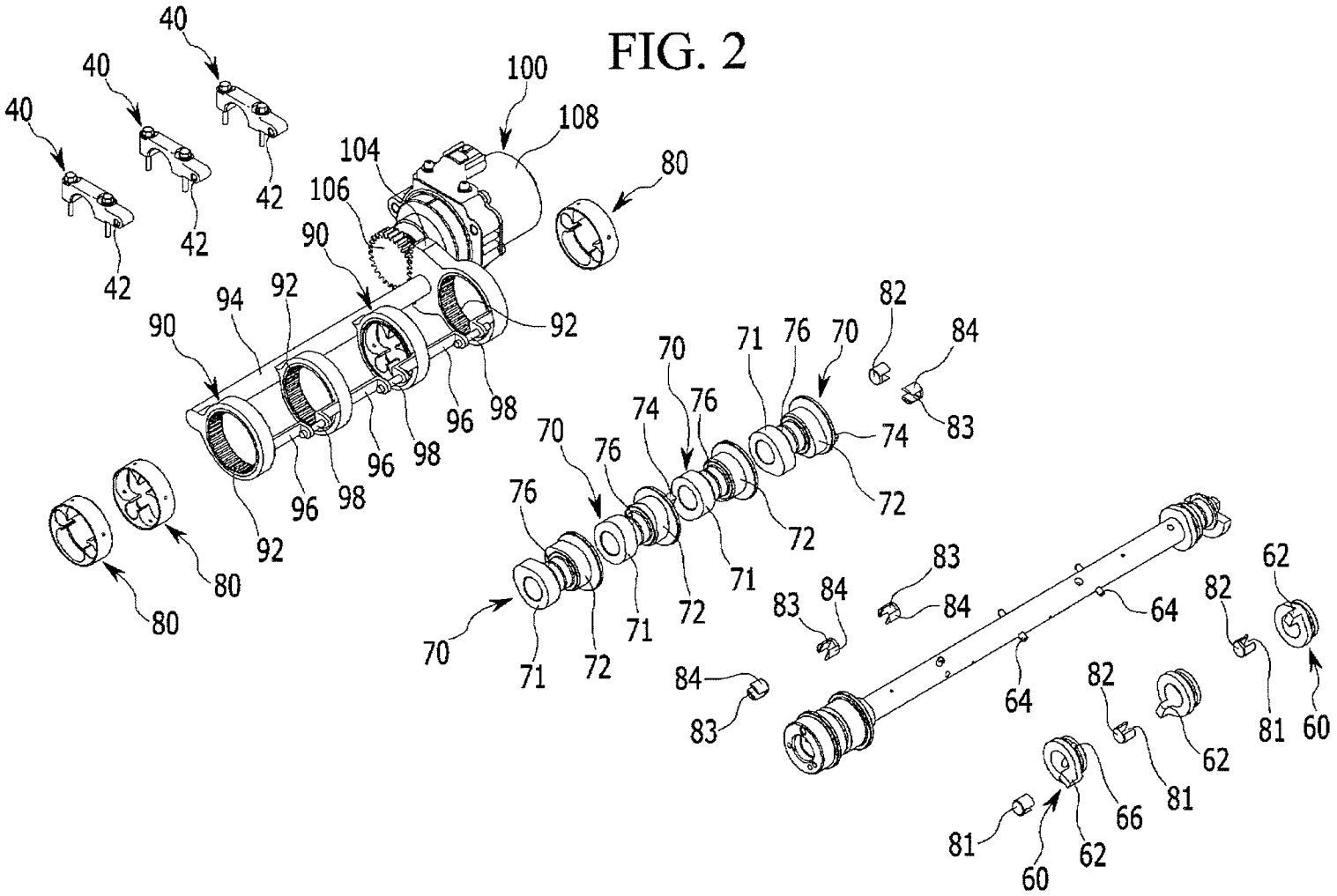
FIG. 2 is an exploded perspective view of a continuous variable valve duration apparatus according to an exemplary embodiment of the present invention.
Figure 3:
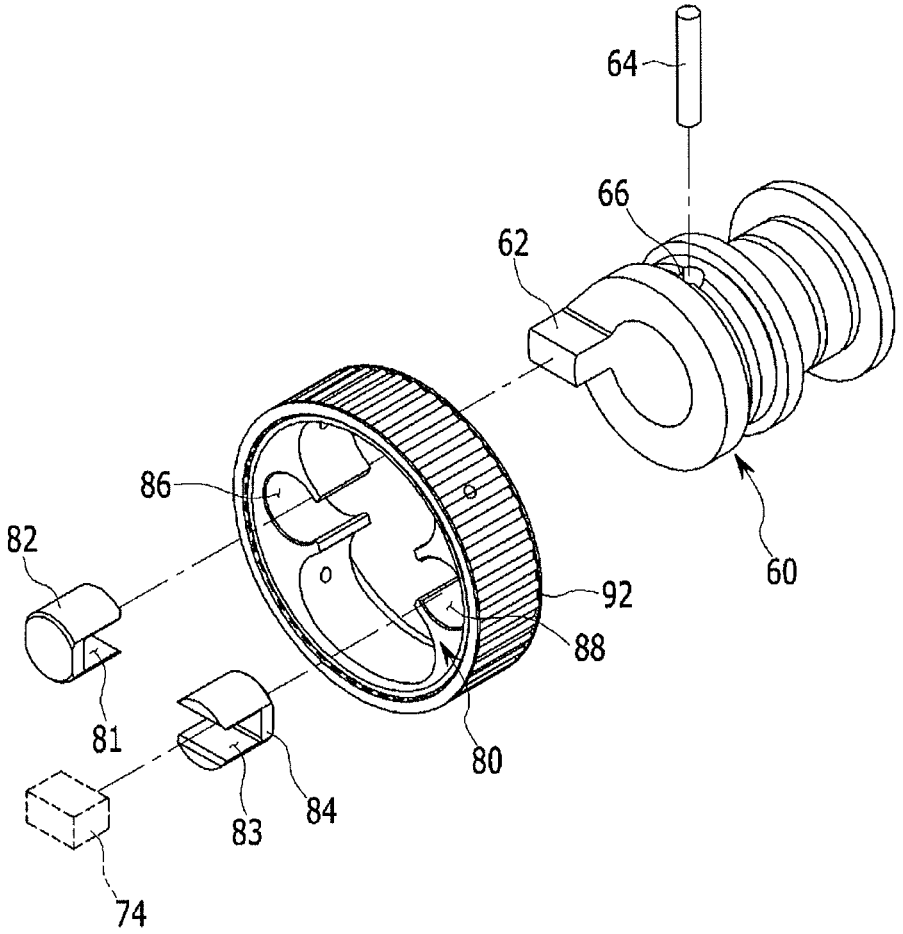
FIG. 3 is a partial exploded perspective view of a continuous variable valve duration apparatus according to an exemplary embodiment of the present invention.

FIG. 1 is a perspective view of an engine provided with a continuous variable valve duration apparatus according to an exemplary embodiment of the present invention, FIG. 2 is an exploded perspective view of a continuous variable valve duration apparatus according to an exemplary embodiment of the present invention, and FIG. 3 is a partial exploded perspective view of a continuous variable valve duration apparatus according to an exemplary embodiment of the present invention.

Referring to FIG. 1 to FIG. 3, an engine according to an exemplary embodiment of the present invention includes an engine block 1, and a cylinder head 10 disposed on the engine block 1 and a continuous variable valve duration apparatus mounted to the cylinder head 10.

The continuous variable valve duration apparatus includes a camshaft 30, a plurality of wheels 60 mounted to the camshaft 30, of which a wheel key 62 is formed thereto respectively, a plurality of cam portions 70 of which a cam 71 and/or 72 and a cam key 74 are formed thereto respectively, of which the camshaft 30 is inserted thereto, of which relative phase angle with respect to the camshaft 30 is variable, a plurality of inner brackets 80 connected with the each wheel key 62 and the each cam key 74, a plurality of a slider housings 90 of which the each inner bracket 80 is rotatably inserted thereto respectively, and rotatably configured around a hinge hole 42 formed a side of a cam cap 40 and a control portion 100 selectively moving the slider housings 90 so as to change relative position of a rotation center of the inner brackets 80.

The camshaft 30 may be an intake camshaft or an exhaust camshaft.

In the drawing, the cam 71 and 72 is formed as a pair, but it is not limited thereto.

While the cam cap engaging portion 76 is formed between the cams 71 and 72 in the drawings, but it is not limited thereto.

The cams 71 and/or 72 contacts to open valve 200.

The engine includes a plurality of cylinders 201, 202, 203 and 204, and the plurality of wheels 60 and the plurality of the cam portions are disposed corresponding to the each cylinder 201, 202, 203 and 204 respectively.

In the drawing, 4 cylinders are formed to the engine, but it is not limited thereto.

The camshaft 30 and the wheel 60 are connected through a connecting pin 64.

The continuous variable valve duration apparatus further includes first pins 82 of which a wheel key slot 81, the each wheel key 62 is slidably inserted thereto, is formed thereto respectively and second pins 84 of which a cam key slot 83, the each the cam key 74 is slidably inserted thereto, is formed thereto respectively. And a first sliding pin hole 86 and a second sliding pin hole 88, of which the first pin 82 and the second pin 84 are inserted thereto respectively are formed to the inner bracket 80.

The first pin 82 and the second pin 84 are formed as a circular cylinder shape and the first sliding pin hole 86 and the second sliding pin hole 88 are formed for the first pin 82 and the second pin 84 to be rotated within thereto. Since the first pin 82, the second pin 84, the first sliding pin hole 86 and the second sliding pin hole 88 are formed as a circular cylinder, thus wear resistance may be enhanced.

Also, productivity may be increased due to simple shapes of the first pin 82, the second pin 84, the first sliding pin hole 86 and the second sliding pin hole 88.

The wheel key slot 81 of the first pin 82 and the cam key slot 83 of the second pin 84 are formed opposite direction.

Parts of the first sliding pin hole 86 and the second sliding pin hole 88 are opened for movements of the wheel key 62 and the cam key 74 not to be interrupted.

A bearing 92 is inserted between the slider housing 90 and the inner bracket 80. Thus, rotation of the inner bracket 80 may be easily performed.

In the drawings, the bearing 92 is depicted as a needle bearing, however it is not limited thereto. On the contrary, various bearings such as a ball bearing, a roller bearing and so on may be applied thereto.

The slider housings 90 are connected each other through a slider housing connecting rod 94 and a connecting bracket 96. Thus rotation positions of the slider housings 90 are integrally controlled and stably assembled.

A hinge pin 98, inserted into the hinge hole 42, is connected the connecting bracket 96.

Figure 4:
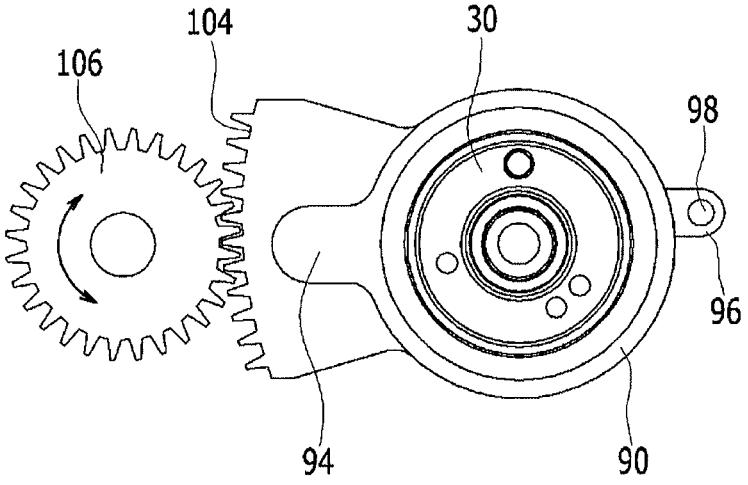
FIG. 4 and FIG. 5 are drawings showing operations of a continuous variable valve duration apparatus according to an exemplary embodiment of the present invention.
Figure 5:
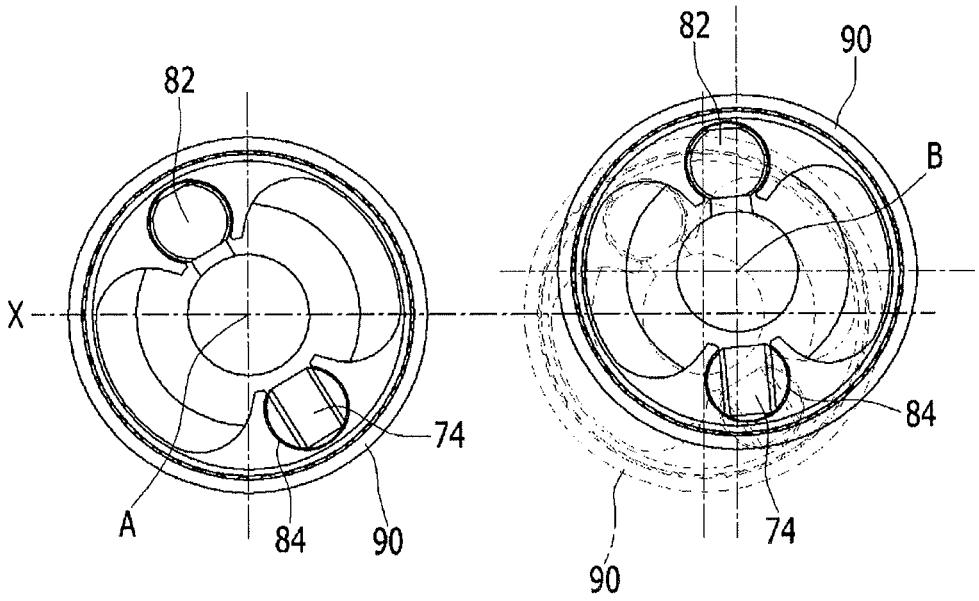

FIG. 4 and FIG. 5 are drawings showing operations of a continuous variable valve duration apparatus according to an exemplary embodiment of the present invention.

Referring to FIG. 1 to FIG. 5, the control portion 100 includes a control gear 104 connected to the slider housing 90 and a control motor 108 selectively rotating a motor gear 106 engaged with the control gear 104.

Referring to FIG. 1 to FIG. 5, operations of a continuous variable valve duration apparatus according to an exemplary embodiment of the present invention will be discussed.

According to engine operation states, an ECU (engine control unit or electric control unit) transmits control signals to the motor 108 of the control portion 100 to change a relative position of the slider housing 90. For example, a relative position of the slider housing 90 is change along up and down direction of an engine.

For example, as shown in FIG. 4 and FIG. 5 when the motor 108 rotates the control gear 104 for the slider housing 90 to be moved, the rotation center of the inner bracket 80 moves with respect to the rotation center of the camshaft 30. Thus, angular acceleration of the cam portion 70 is changed so as that duration of the valves 200 is changed.

As shown in the left side of FIG. 5, the rotation center of the inner bracket 80 coincides with the rotation center of the cam shaft 30, and "A" indicates the rotation centers of the inner bracket 80 and the cam shaft 30.

In this state, if the motor 108 rotates the control gear 104, relative positions of the slider housing 90 and the inner bracket 80 are changed. Thus, as shown a right side of FIG. 5, a rotation center of the inner bracket 80 is changed to B, then the rotation center of the inner bracket 80 with respect to that of the camshaft 30 is changed.

Figure 6:
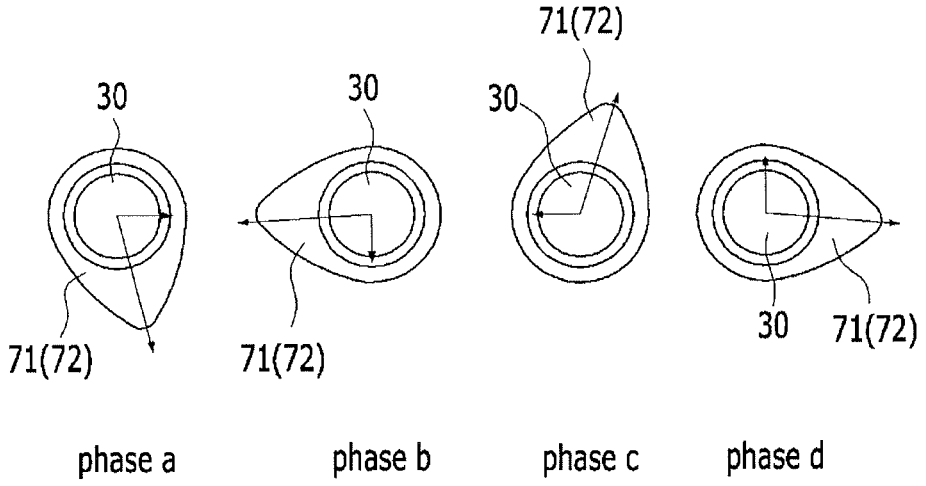
FIG. 6 and FIG. 7 are drawings showing mechanical motions of cams of a continuous variable valve duration apparatus according to an exemplary embodiment of the present invention.
Figure 7:
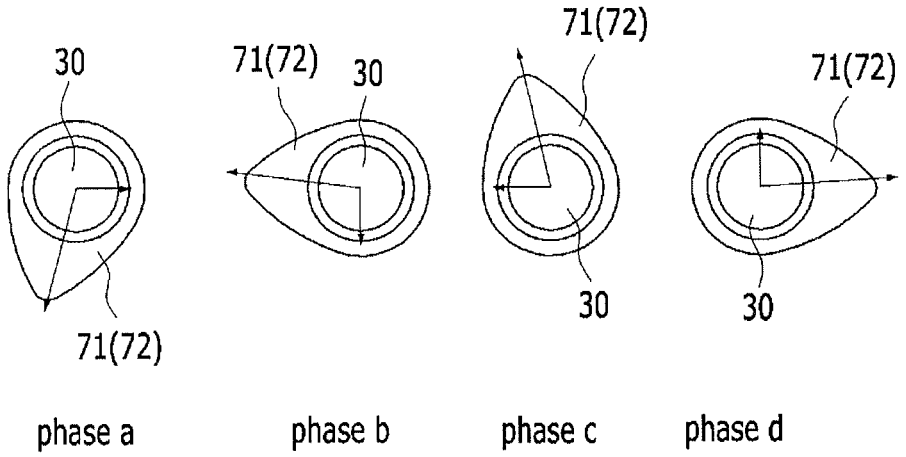

FIG. 6 and FIG. 7 are drawings showing mechanical motions of cams of a continuous variable valve duration apparatus according to an exemplary embodiment of the present invention.

As shown in FIG. 6, while the phase angle of the camshaft 30 is constantly changed when the relative rotation center of the cams 71 and 72 with respect to the rotation center of the camshaft 30 is changed downward, the rotation speed of the cams 71 and 72 is relatively faster than rotation speed of the camshaft 30 from phase a to phase b and from phase b to phase c, then the rotation speed of the cams 71 and 82 is relatively slower than rotation speed of the camshaft 30 from phase c to phase d and from phase d to phase a. That is, the valve duration is changed.

As shown in FIG. 7, while the phase angle of the camshaft 30 is constantly changed when the relative rotation center of the cams 71 and 72 with respect to the rotation center of the camshaft 30 is changed upward, the rotation speed of the cams 71 and 72 is relatively slower than rotation speed of the camshaft 30 from phase a to phase b and from phase b to phase c, then the rotation speed of the cams 71 and 82 is relatively faster than rotation speed of the camshaft 30 from phase c to phase d and from phase d to phase a. That is, the valve duration is changed.

While the wheel 60 is rotated together with the camshaft 30, the wheel key 62 is slidable within the wheel key slot 81, the first pin 82 and the second pin 84 are rotatable within the first sliding pin hole 86 and the second sliding pin hole 88 respectively and the cam key 74 is slidable within the cam key slot 83. Thus, when the relative rotation centers of the inner bracket 80 and the camshaft 30 are changed, the relative rotation speed of the cams 71 and 72 with respect to the rotation speed of the camshaft 30 is changed.

Figure 8:
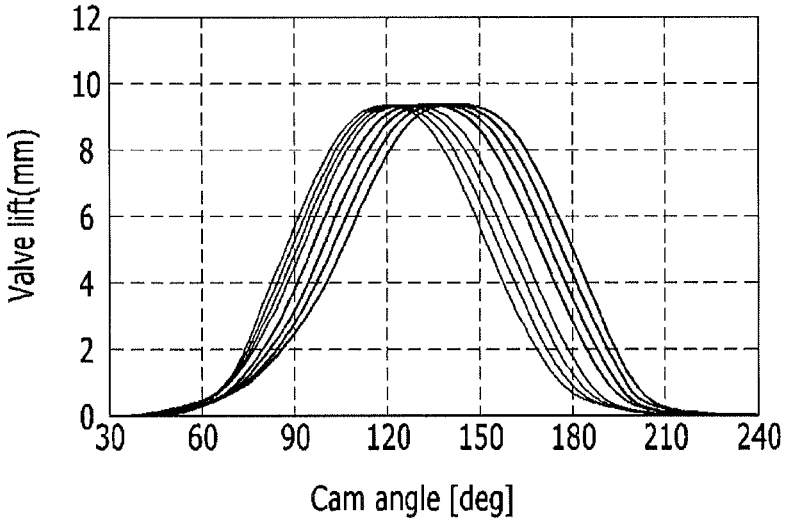
FIG. 8 is a graph of a valve profile of a continuous variable valve duration apparatus according to an exemplary embodiment of the present invention.

FIG. 8 is a graph of a valve profile of a continuous variable valve duration apparatus according to an exemplary embodiment of the present invention.

As shown in FIG. 8, although maximum lift of the valve 200 is constant, however rotation speed of the cam 71 and 72 with respect to the rotation speed of the camshaft 30 is changed according to relative positions of the slider housing 90 so that duration of the valve 200 is changed and various valve profile may be performed.

As an example shown in FIG. 8, opening time of the valve 200 is constant and closing time of the valve 200 is controlled, however, it is not limited thereto. According to mounting angle of the valve 200 and so on, various valve durations may be performed.

Determinations of the control signals of the ECU according to the engine operation state is obvious to a person skilled in the art, thus detailed description will be omitted.

As described above, a continuous variable valve duration apparatus according to an exemplary embodiment of the present invention may vary duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A valve duration control apparatus comprising:

a camshaft;

a plurality of wheels mounted to the camshaft, wherein each wheel includes a wheel key;

a plurality of cam portions each including a cam and a cam key, wherein the camshaft being inserted through the plurality of cam portions so that a relative phase angle of each of the plurality of cam portions with respect to the camshaft is variable;

a plurality of inner brackets respectively connected with each wheel key and each cam key, the plurality of inner brackets respectively and rotatably inserted into a plurality of slider housings;

a plurality of cam caps each including a hinge hole, wherein the plurality of slider housings are respectively and rotatably mounted to the hinge hole of each cam cap; and a control portion moving the plurality of slider housings so as to change a position of a rotation center of the plurality of inner brackets relative to a rotation center of the camshaft.

2. The valve duration control apparatus of claim 1, further comprising:

first pins, each of which includes a wheel key slot, wherein the respective wheel key is slidably inserted into the respective wheel key slot; and second pins, each of which includes a cam key slot, wherein the respective cam key is slidably inserted into the respective cam key slot, and wherein a first sliding pin hole and a second sliding pin hole are formed to each inner bracket of the plurality of inner brackets and the first pin and the second pin are respectively inserted therein.

3. The valve duration control apparatus of claim 2, wherein each of the first pins and each of the second pins has a circular cylinder shape; and wherein each first pin and each second pin is rotatable in the respective first sliding pin hole and the respective second sliding pin hole.

4. The valve duration control apparatus of claim 3, wherein the respective wheel key slot of the first pins is formed in an opposite direction to the respective cam key slot of the second pins.

5. The valve duration control apparatus of claim 4, wherein parts of the respective first sliding pin hole and the respective second sliding pin hole are open so that the respective wheel key and the respective cam key are movable through the open parts of the respective first sliding pin hole and the respective second sliding pin hole.

6. The valve duration control apparatus of claim 1, further comprising:

a bearing inserted between each slider housing of the plurality of slider housings and the corresponding respective inner bracket of the plurality of inner brackets.

7. The valve duration control apparatus of claim 1, wherein adjacent slider housings of the plurality of slider housings are connected to each other via a slider housing connecting rod and a connecting bracket; and wherein a hinge pin inserted into the hinge hole, is connected to the connecting bracket.

8. The valve duration control apparatus of claim 7, wherein the control portion comprises:

a control gear connected to the plurality of slider housings; and a control motor engaged with the control gear and configured to rotate the control gear.

9. The valve duration control apparatus of claim 1, wherein each of the plurality of wheels is connected with the camshaft through a connecting pin.

10. An engine comprising:

a camshaft;

a plurality of cylinders;

a plurality of wheels mounted to the camshaft and disposed corresponding to each cylinder of the plurality of cylinders, wherein each wheel includes a wheel key;

a plurality of cam portions each including a cam and a cam key, wherein the camshaft is inserted through the plurality of cam portions so that a relative phase angle of each of the plurality of cam portions with respect to the camshaft is variable, the plurality of cam portions being respectively disposed corresponding to each cylinder of the plurality of cylinders;

a plurality of inner brackets of which a first sliding pin hole and a second sliding pin hole, connected with each wheel key and each cam key, are formed respectively thereto;

a plurality of slider housings, the plurality of inner brackets being respectively and rotatably inserted into the plurality of slider housings;

a plurality of cam caps each including a hinge hole, wherein the plurality of slider housings are respectively and rotatably mounted to the hinge hole of each cam cap;

first pins rotatably inserted into the respective first sliding pin hole wherein each of the first pins includes a wheel key slot and each wheel key is slidably inserted into the respective wheel key slot;

second pins, and each of the second pins includes a cam key slot, wherein each cam key is slidably inserted into the respective cam key slot, and wherein each second pin is formed opposite to the respective wheel key slot, and rotatably inserted into the respective second sliding pin hole; and a control portion moving the plurality of slider housings so as to change a position of a rotation center of the plurality of inner brackets relative to a rotation center of the camshaft.

11. The engine of claim 10, wherein parts of the respective first sliding pin hole and the respective second sliding pin hole are open so that the respective wheel key and the respective cam key are movable through the open parts of the respective first sliding pin hole and the respective second sliding pin hole.

12. The engine of claim 10, further comprising:

a bearing inserted between each slider housing of the plurality of slider housings and the corresponding respective inner bracket of the plurality of inner brackets.

13. The engine of claim 10, wherein adjacent slider housings of the plurality of slider housings are connected to each other via a slider housing connecting rod and a connecting bracket; and wherein a hinge pin inserted into the hinge hole, is connected to the connecting bracket.

14. The engine of claim 13, wherein the control portion comprises:

a control gear connected to the plurality of slider housings; and a control motor engaged with the control gear and configured to rotate the control gear.

15. The engine of claim 10, wherein each of the plurality of wheels is connected with the camshaft through a connecting pin.

* * * * *